United States Patent [19]

Inoue et al.

[11] 4,206,088

[45] Jun. 3, 1980

[54] SOLID CONDUCTING AGENT

[75] Inventors: Eiichi Inoue; Hiroshi Kokado, both of Tokyo; Nobuhiro Miyakawa, Kobe, all of Japan

[73] Assignee: Mita Industrial Company Limited, Osaka, Japan

[21] Appl. No.: 875,760

[22] Filed: Feb. 7, 1978

[51] Int. Cl.[2] ..... H01B 1/00

[52] U.S. Cl. ..... 252/500; 252/518; 428/404; 252/62.2; 430/31; 430/84; 430/107

[58] Field of Search ..... 252/500, 62.1 P, 518; 428/404; 96/1 E

[56] References Cited

U.S. PATENT DOCUMENTS 3,893,935 7/1975 Jadwin et al. ..... 252/62.1 P 3,948,654 4/1976 Fisher ..... 252/62.1 P X 3,996,392 12/1976 Berg et al. ..... 252/62.1 P X

*Primary Examiner*—E. Suzanne Parr

*Attorney, Agent, or Firm*—Sherman & Shalloway

[57] ABSTRACT

A solid conducting agent comprising a finely divided inorganic solid acid and at least 0.5% by weight of a protonically conductive solid adsorbed and supported on the finely divided inorganic solid acid.

This solid conducting agent is characterized by much reduced humidity dependency of the electric conductivity, and it has a sufficient electric conductivity even under low humidity conditions. An electro-responsive recording material including a layer of this solid conducting agent does not show a tacking phenomenon even under high humidity conditions.

8 Claims, No Drawings

SOLID CONDUCTING AGENT

BACKGROUND OF THE INVENTION (1) Field of the Invention:

The present invention relates to an inorganic solid conducting agent. More particularly, the invention relates to an inorganic solid conducting agent for an electro-responsive recording material, which has an improved humidity dependency and a high resistance to tacking.

By the term "electro-responsive recording material" is meant a recording material capable of performing recording in response to electric signals or performing recording by utilizing an electric energy and other energy, for example, light energy, in combination. As the recording material included in the concept of the electro-responsive recording material, there can be mentioned, for example, an electrolytic recording material, an electric discharge recording material, an electrostatic recording material and an electrophotographic photosensitive recording material. Irrespective of the image forming mechanism, in order to form a clear image promptly, it is important that each of these electro-responsive recording materials should satisfy the requirement that an appropriate electrically conductive layer should be present in the material when it is actually applied to the recording operation.

(2) Description of the Prior Art:

As the conducting agent for rendering these recording materials electrically conductive, there are known various substances, for example, metal powders, carbon black, water-soluble and moisture-absorptive inorganic and organic salts, surface active agents, wetting agents such as polyhydric alcohols, and polymeric electrolytes, and these conducting are actually used in the art. These known conducting agents, however, have some defects or other and are still insufficient in various points.

For example, conducting agents such as metal powders and carbon black are good conductors and they have a merit that their electric conductivity is not influenced by the humidity, but they have a fatal defect that they generally have an inherent color or opacity. From the viewpoints of the sharpness and contrast of formed images, it is important that a recording material should be excellent in the whiteness, and it is generally desired that recording materials having images formed thereon may be used as originals for customary copying processes such as diazo and electrophotographic copying processes. Recording materials including a metal powder or carbon black as the conducting agent fail to meet this requirement. Moreover, the weights of recording materials of this type are heavy and they are relatively expensive.

Other conducting agents such as salts, activating agents, organic wetting agents and polymeric electrolytes are rendered electrically conductive only in the presence of water, and therefore, they inevitably involve various defects. For example, electrolytic recording materials comprising a salt or the like as the conducting agent must be used in the humidified state (wet state), and especial care should be taken to storage conditions prior to actual application. Moreover, in case of these recording materials, since recording is carried out according to a wet method, bleeding is readily caused in a formed image. Further, an electrostatic recording material or electrophotographic recording material comprising an electrically conductive layer composed of a polymeric electrolyte such as a cationic conductive resin or anionic conductive resin has a merit that is need not be used in the especially humidified state, but its electric conductivity is greatly influenced by the humidity. For example, when a recording material of this type is allowed to stand in a low humidity atmosphere for a long time, the image sharpness is drastically degraded by reduction of the electric conductivity. On the other hand, in a high humidity atmosphere, because of the water solubility of the polymeric electrolyte, there is brought about a disadvantage that recording sheets readily tack each other.

SUMMARY OF THE INVENTION

We found that a conducting agent formed by making a protonically conductive solid adsorbed and supported on a fine powder of an inorganic solid acid in an amount of at least 0.5% by weight has a certain electric conductivity under low humidity conditions, especially in the absolutely dry state, it does not show any tacking phenomenon even under high humidity conditions and it is very valuable as a conducting agent for an electro-responsive recording material. It was also found that when a protonically conductive solid is used in the above-mentioned specific form in combination with a fine powder of an inorganic solid acid, the intended electric conductivity can be attained by the use of a much smaller amount of the protonically conductive solid than in the case where the protonically conductive solid is used alone. Further, the electric conductivity attained by this conducting agent is so high as not be expected from the electric conductivity attainable by the single use of the protonically conductive solid or the finely divided solid acid.

Still further, in conventional conducting agents, the conductivity is reduced as the application temperature is elevated. On the other hand, in case of the solid conducting agent of the present invention, the conductivity is enhanced as the application temperature is elevated. This is another advantage attained by the above-mentioned solid conducting agent of the present invention.

When the solid conducting agent of the present invention is used for an electro-responsive recording material, in addition to the aforementioned advantages, there is attained an advantage that an electro-responsive recording material having a very excellent whiteness can be obtained. More specifically, a fine powder of a solid acid that is used in the present invention is a fine powder generally excellent in the whiteness and pigment characteristics, and a protonically conductive solid that is used in the present invention is a solid substance in which the degree of coloration is much lower than in ordinary organic bases and the like. Further, when this protonically conductive solid is adsorbed and supported on the finely divided solid acid, the whiteness and pigment characteristics of the latter solid can be further enhanced. The solid conducting agent of the present invention can be dispersed very easily into a known binder composition for a paint or the like and by the use of the solid conducting agent of the present invention, it is made possible to form on a substrate an electrically conductive layer excellent in the whiteness and surface smoothness.

DETAILED DESCRIPTION OF THE PREFERRED EMBODIMENTS

The present invention will now be described in detail.

In the instant specification and appended claims, by the term "protonically conductive solid" is meant a solid electrolyte in which the movable ion is a proton. This solid electrolyte has a proton as the movable ion even in the absolutely dry state, and the main difference of this solid electrolyte from ordinary solid electrolytes resides in that it shows an ionic conductivity even in the absolutely dry state.

It is preferred that the volume resistivity of the protonically conductive solid be lower than $1\times10^{13}\Omega$-cm, especially lower than $2.5\times10^{12}\Omega$-cm, in the absolutely dry state. From viewpoints of easy availability and low electric resistance, an acid addition salt of an organic base is preferred as the protonically conductive solid. However, other known protonically conductive solids can be used in the present invention so far as the above requirement is satisfied.

A protonically conductive solid composed of an acid addition salt of an organic base that is used in the present invention is prominently advantageous over low-molecular-weight or high-molecular-weight quaternary ammonium salts which have customarily been used as conducting agents. In a conducting agent of the quaternary ammonium salt type, the movable ion is an anion present as the counter ion. On the other hand, the movable ion in the conducting agent of the present invention is a proton (hydrogen ion), and therefore, the protonically conducting solid of the present invention is excellent over the conventional quaternary ammonium salt in respect to the movility of the ion. More specifically, in case of the conventional quaternary ammonium salt, the electric conductivity is attained for the first time only in the presence of water, but in case of the conducting agent of the present invention, the presence of water is not indispensable for manifestation of the electric conductivity.

As the organic base constituting the protonically conductive solid, there can be mentioned, for example, primary, secondary and tertiary, aliphatic, alicyclic, aromatic and heterocyclic amines, hydrazine and its derivatives, quanidine and its derivatives, and imines. These bases may be either low-molecular-weight compounds or high-molecular-weight compounds.

Suitable examples of organic bases that can be used in the present invention are shown in Table 1, though organic amines usable in the present invention are not limited to those shown in Table 1.

Table 1

| Compound Name | First Stage Base Dissociation Constant (pKb) | Ratio of Number of Carbon Atoms to Number of Nitrogen Atoms (C/N) |
|---|---|---|
| A. Primary Amines | | |
| Methylamine | 3.38 | 1 |
| Ethylamine | 3.37 | 2 |
| Amylamine | 3.37 | 5 |
| Cyclohexylamine | 3.36 | 6 |
| 1,2-Cyclohexane diamine | — | 3 |
| Allylamine | 3.51 | 3 |
| Hydroxylamine | 8.03 | 0 |
| Benzylamine | 3.66 | 7 |
| Ethanolamine | 4.50 | 2 |
| ethylenediamine | 4.02 | 1 |
| Polyvinylamine | — | 2 |
| 3-Amino-1H-1,2,4-triazole | — | 0.5 |
| B. Secondary Amines | | |
| Dimethylamine | 3.13 | 2 |
| Diethylamine | 3.02 | 4 |
| Diisobutylamine | 3.50 | 8 |
| Piperidine | 2.78 | 5 |
| Piperazine | — | 2 |
| Morpholine | 5.64 | 4 |
| Pyrrolidine | 2.73 | 4 |
| Trimethylene-imine | 2.71 | 3 |
| Diallylamine | 4.71 | 6 |
| Polyethylene-imine | — | 2 |
| Hexamethylene tetra-amine | — | 1.5 |
| C. Tertiary Amines | | |
| Trimethylamine | 4.24 | 3 |
| Triethylamine | 3.35 | 6 |
| N-Ethylpiperizine | 3.6 | 7 |
| N-Methylmorpholine | 6.59 | 5 |
| Triethanolamine | 6.23 | 6 |
| 4-Aminopyridine | 4.83 | 2.5 |
| Polyvinylpyridine | — | 6 |
| D. Hydrazines | | |
| Hydrazine | 6.07 | 0 |
| Methylhydrazine | 6.13 | 0.5 |
| Ethylhydrazine | 6.29 | 1 |
| E. Guanidines | | |
| Guanidine | 0.41 | 0.33 |
| Phenylguanidine | 3.23 | 3.5 |
| Triphenylguanidine | 4.9 | 6.3 |
| Tetramethylguanidine | — | 1.3 |
| F. Heteroxyclic Amines | | |
| 2,2'-Bis-pyridine | 9.88 | 5 |
| Guanazole | — | 0.4 |
| Urazine | — | 0.67 |
| 6-Aminopurine | 4.20 | 1 |

It is generally preferred that the base that is used in the present invention should satisfy either of the following two requirements (i) and (ii), especially both of them: (i) the ratio of the number of carbon atoms to the number of nitrogen atoms (C/N) is within a range of from 0 to 8, especially from 1 to 4, and (ii) the first stage base dissociation constant (pKb, as determined at 20° C.) is in the range of from 0.3 to 8, especially from 2 to 6.

More specifically, according to a preferred embodiment of the present invention, by selecting and using an organic base in which the above C/N or pKb value is in the above-mentioned range, the electric conductivity of the resulting conducting agent can be remarkably enhanced over the electric conductivity of a conducting agent including an organic base having the C/N or pKb value outside the above range. The reason has not been completely elucidated but it is construed that when the C/N or pKb value is below the above range, bonding of the acid addition salt is extremely strong and dissociation of the proton becomes difficult even in an electric field, and that when the C/N or pKb value is above the above range, bonding of the acid addition salt is weakened and formation of the proton per se becomes difficult or the proton concentration is drastically lowered.

Any of inorganic and organic acids can optionally be used as the acid constituting the protonically conductive solid of the present invention. However, from the viewpoint of the electric conductivity of the final conducting agent, it is preferred to use an acid having a first stage acid dissociation constant (pKa, as measured at 25° C.) not higher than 6.5, especially not higher than 5.

Suitable examples of inorganic acids include hydrohalogenic acids such as hydrochloric acid, sulfur oxyacids such as sulfuric acid and sulfurous acid, nitrogen oxyacids such as nitric acid and nitrous acid, and phosphorus oxyacids such as ortho-phosphoric acid, meta-phosphoric acid and pyrophosphoric acid. Suitable examples of organic acids include carboxylic acids such as formic acid, acetic acid, trichloroacetic acid, crotonic acid, glycolic acid, salycilic acid, p-hydroxybenzoic acid, oxalic acid, malonic acid, succinic acid, tartaric acid, azelaic acid, maleic acid, citric acid, pyromellitic acid and glutamic acid, sulfonic acids such as methane-sulfonic acid, benzene-sulfonic acid and p-toluene-sulfonic acid, and phosphonic acids and phosphinic acids. As preferred acids, sulfuric acid, hydrochloric acid, phosphoric acid, nitric acid and sulfonic acid can be mentioned in the order of importance.

The acid addition salt of the organic base that is used in the present invention may be neutral, acidic or basic depending on the valency of the base or acid. Neutral, acidic or basic salts can easily be obtained by changing the reaction mole ratio between the organic base and the acid.

In the present invention, it is very important that the above-mentioned protonically conductive solid should be adsorbed and supported on a finely divided inorganic solid acid. For example, as illustrated in Examples 1 and 2 given hereinafter, the volume resistivity of finely divided silica as the solid acid is $2.00\times10^8\Omega$-cm (as measured at 23° C. and 50% relative humidity) (in the instant specification, the volume resistivity is one as measured under these conditions unless otherwise indicated) and the volume resistivity of guanidine sulfate as the protonically conductive solid is $6.69\times10^7\Omega$-cm. On the other hand, when 1% by weight (in the instant specification, all of "%" and "parts" are by weight unless otherwise indicated) of guanidine sulfate is adsorbed and supported on the above solid acid powder according to the present invention, the volume resistivity of the resulting conducting agent is reduced to such a low level as $5.31\times10^5\Omega$-cm. This means that the electric conductivity of the conducting agent is about 380 times the electric conductivity of the solid acid and about 130 times the electric conductivity of the protonically conductive solid. Similarly, when hexamethylenetetraamine succinate as the protonically conductive solid is adsorbed and supported on activated clay as the solid acid, the electric conductivity of the resulting conducting agent is about 5 times that of the solid acid and about 50,000 times that of the protonically conductive solid.

The fact that the electric conductivity is synergistically enhanced by adsorbing and supporting a protonically conductive solid on an inorganic solid acid clearly demonstrates that the conducting agent of the present invention is not a mere mixture of both the solids.

By the term "fine powder of an inorganic solid acid" or "finely divided inorganic solid acid" referred to in the instant specification and appended claims is meant a fine powder of an inorganic acid having characteristics of a Brønsted acid or Lewis acid. As such inorganic solid acid, there can optionally be used any of natural, synthetic, by-product, regenerated and activated inorganic acids containing silica, alumina or aluminosilicate components. Suitable examples of the solid acid are as follows:

(A) Natural clay minerals and activated clay minerals:
Montmorillonite clays such as bentonite, acid clay, fuller's earth and sub-bentonite, kaolin clays such as kaolin, and their acid-treated activated clays.

(B) Amorphous silica:
Dry method amorphous silica powder commercially available under tradename "Aerosil" (product of Nippon Aerosil) and wet method amorphous silica powders commercially available under tradenames "Mizukasil" (product of Mizusawa Kagaku Kogyo), "Tokusil" (product of Tokuyama Soda) and "Syloid" (product of Fuji-Davison).

(C) Active alumina:
Amorphous alumina and alumina hydrate.

(D) Compound oxides:
Silica-alumina, silica-magnesia, silica-boria.

(E) Solid phosphates:
Sintered products of compositions of silica or alumina and phosphoric acid.

(F) Other inorganic chemicals:
Amorphous titanium oxide, titanium phosphate, zirconium phosphate.

From the viewpoint of synergistic enhancement of the electric conductivity, it is generally preferred that the finely divided inorganic solid acid should have an adsorptive property. More specifically, it is preferred that the BET specific surface area of the finely divided inorganic solid acid be at least 50 $m^2/g$, especially at least 100 $m^2/g$. In other words, it is important that the finely divided inorganic solid acid that is used in the present invention should support tightly the protonically conductive solid by absorbing or adsorbing the protonically conductive solid thereon. From this viewpoint, it is preferred to use a clay mineral or its acid-treated product or amorpous silica. Moreover, from the viewpoints of the electric conductivity, whiteness and adaptability to the coating operation, it is important that the inorganic solid acid should be in the finely divided state. In generally, it is preferred that the particle size of the inorganic solid acid be smaller than $20\mu$, especially smaller than $10\mu$.

In general, the solid conducting agent of the present invention is prepared according to a process comprising contacting a solution of a protonically conductive solid with a fine powder of an inorganic solid acid to make the protonically conductive solid adsorbed and supported on the fine powder of the solid acid in an amount of at least 0.5% by weight based on the fine powder of the solid acid, and washing and drying the powder of the solid acid according to need.

Since the above-mentioned protonically conductive solid is soluble in an aqueous medium, it is preferred to use it in the form of an aqueous solution having a concentration of 5 to 50%, especially 10 to 30%. The ratio of the solution of the protonically conductive solid to the finely divided inorganic solid acid is not particularly critical so far as uniform and intimate contact can be attained between them. In general, however, it is preferred that the solution of the protonically conductive solid be used in such an amount that the weight of the solution is 1 to 50 times the weight of the finely divided inorganic solid acid.

In order to attain synergistic enhancement of the electric conductivity, it also is important that the protonically conductive solid should be adsorbed and supported on the finely divided inorganic solid acid in an amount of at least 0.5%, preferably at least 1%, especially preferably at least 3%. However, even if the protonically conductive solid is adsorbed and supported in an amount exceeding 10%, especially 20%, no substantial effect of increasing the electric conductivity is attained, but the tacking phenomenon is readily caused at a high humidity or an economical disadvantage is brought about.

The contact time and temperature are determined so that the above-mentioned amount of the protonically conductive solid is adsorbed and supported on the finely divided inorganic solid acid. For example, the contact temperature may be selected within the range from room temperature to the boiling point of the solution, but in order to adjust the adsorption speed, it is possible to reduce the temperature of the mixture below room temperature or to perform the contact treatment at a temperature higher than the boiling point of the solution under pressure. The contact time is changed depending on the concentration of the solution, the quantity of the solution and the contact time, but in general, it is preferred to complete the contact treatment in 5 minutes to 6 hours.

The finely divided solid acid having the protonically conductive solid adsorbed and supported thereon is separated from the mother liquor by known liquid-solid separating means such as filtration, centrifugal separation or decantation, and it is then water-washed and dried according to need. Instead of this solid-liquid separation method, there may be adopted a method in which after the solution of the protonically conductive solid has been contacted with the fine powder of the solid acid under predetermined conditions, the mixture is directly spray-dried to form a conducting agent of the present invention.

In order to improve the electric characteristics, dispersibility and other properties, the solid conducting agent of the present invention may be subjected to various post treatments. For example, a polyhydric alcohol having a vapor pressure lower than 0.1 mm Hg, especially lower than 0.05 mm Hg, as measured at 20° C. and being liquid under normal conditions may be incorporated into the solid conducting agent of the present invention, whereby the conductivity under low humidity conditions can be further improved prominently. It is construed that the reason for this improvement is that the polyhydric alcohol has a function of reducing dissociating energy of the proton. The amount incorporated of the polyhydric alcohol should be controlled within a certain range. More specifically, it is generally preferred that the polyhydric alcohol be incorporated in an amount of 0.5 to 6%, especially 1 to 4%, based on the inorganic solid acid. If the amount of the polyhydric alcohol is outside this range, the electric conductivity is rather reduced.

Polyhydric alcohols which are solid under normal conditions, such as pentaerythritol, mannitol, sorbitol and glucose, have not such effect of improving the electric conductivity under low humidity conditions at all.

As such polyhydric alcohol, there are preferably employed glycols represented by the following general formula:

$$HO(R^1O)_nH$$

wherein $R^1$ stands for an alkylene group having 2 to 10 carbon atoms and n is a number of at least 1 which is selected so that the glycol is liquid under normal conditions, and glycerin and diglycerin.

As suitable examples of such glycols, there can be mentioned ethylene glycol, diethylene glycol, triethylene glycol, tetraethylene glycol, polyethylene glycols (in which n is at least 5 and the molecular weight is not higher than 400), propylene glycol, dipropylene glycol, polypropylene glycols (in which n is at least 3 and the molecular weight is not higher than 400), butylene-1,4-glycol, hexylene glycol and octylene glycol.

Further, in order to improve the dispersibility, a nonionic, anionic, cationic or amphoteric surface active agent or the like may be stuck to the solid conducting agent of the present invention.

The conducting agent of the present invention has such a high electric conductivity as cannot be expected from the electric conductivity of the finely divided inorganic solid acid or protonically conductive solid alone. Further, the humidity dependency of this high electric conductivity is much lower than the humidity dependency of the electric conductivity in known inorganic salt conducting agents or organic conducting agents. Moreover, the conducting agent of the present invention retains this high electric conductivity even under low humidity conditions and it does not show a tacking phenomenon even under high humidity conditions. Still further, the conducting agents of the present invention is a fine powder excellent in the whiteness and dispersibility and it can be handled very easily. Therefore, according to the present invention, there can be attained an advantage that an electrically conductive layer excellent in the whiteness and surface smoothness can easily be formed on any of various substrates.

The finely divided conducting agent of the present invention can be used for production of various electroresponsive recording materials by dispersing the conducting agent in a binder medium composed of an optional resin and applying the dispersion onto a substrate such as a paper, a film, a metal foil, a sheet or the like.

The present invention will now be described in more detail by reference to the following Examples that by no means limit the scope of the invention.

EXAMPLE 1

(A) Guanidine sulfate having a volume resistivity of $6.69\times10^7\Omega$-cm (B) Silica gel ("Wakogel" manufactured by Wako Junyaku Kogyo) having a volume resistivity of $2.00\times10^8\Omega$-cm The silica gel (B) was dispersed in a 10% aqueous solution of the protonically conductive solid (A), and the dispersion was filtered and dried to make the protonically conductive solid (A) adsorbed and supported on the silica gel (B) in an amount of about 1% by weight (as measured according to the weight method). The resulting silica powder was a white fine powder having a volume resistivity of $5.31\times10^5\Omega$-cm as measured under the same conditions.

Incidentally, in this and subsequent Examples, all the values of the volume resistivity were those as measured at a temperature of 23° C. and a relative humidity of 50%, unless otherwise indicated.

EXAMPLE 2

(A) Hexamethylene-tetraamine succinate having a volume resistivity of $2.05\times10^{11}\Omega$-cm (B) Activated clay having a volume resistivity of $2.02\times10^7\Omega$-cm In the same manner as described in Example 1, hexamethylene-tetraamine succinate was adsorbed and supported on activated clay in an amount of 1% by weight. The resulting activated clay powder was found to have a volume resistivity of $4.13\times10^{6}\Omega$-cm.

EXAMPLE 3

(A) Piperazine sulfate having a volume resistivity of $9.35\times10^{7}\Omega$-cm (B) Silicic anhydride (precipitated) having a volume resistivity of $1.52\times10^{9}\Omega$-cm Piperazine was adsorbed and supported on powdery silicic anhydride in an amount of about 2.5% by weight in the same manner as described in Example 1. The resulting powder was found to have a volume resistivity of $4.14\times10^{6}\Omega$-cm.

EXAMPLE 4

Tetramethylguanidine sulfate as the protonically conductive solid was adsorbed and supported on kaolin as the solid acid in an amount of about 1%. Separately, glycerin was further adsorbed in an amount of about 1.5% by weight. Electric conductivities of the so obtained samples were measured under different humidity conditions to obtain results shown in Table 2.

Table 2

| Sample | Conductivity ($\Omega^{-1}$-cm$^{-1}$) 25.5° C., 30% RH | 23° C., 50% RH | $\delta_{50}/\delta_{30}$* |
|---|---|---|---|
| non-adsorbed | $1.25\times10^{-10}$ | $6.49\times10^{-9}$ | 51.9 |
| tetramethylguanidine sulfate adsorbed | $8.93\times10^{-8}$ | $5.49\times10^{-7}$ | 6.16 |
| tetramethylguanidine sulfate and glycerin adsorbed | $1.73\times10^{-7}$ | $7.35\times10^{-7}$ | 4.25 |

*The change of the electric conductivity caused by the change of the humidity (between 30% RH and 50% RH); a smaller value indicates a smaller humidity dependency.

As will be apparent from the data shown in Table 2, if tetramethylguanidine sulfate as the protonically conductive solid is adsorbed and supported on kaolin as the solid acid, the humidity dependency of the electric conductivity is reduced to about 1/10 and a sufficient electric conductivity can be attained even under low humidity conditions (714 to 1384 times as high as the value attained in the case where the protonically conductive solid is not adsorbed).

EXAMPLE 5

Ethanolamine hydrochloride as the protonically conductive solid was adsorbed and supported on activated alumina (acidic) as the solid acid in an amount of about 3% by weight, and ethylene glycol was further adsorbed in an amount of about 2% by weight. The resulting sample was found to have a volume resistivity of $3.78\times10^{5}\Omega$-cm as measured at a temperature of 23° C. and a relative humidity of 36%, whereas the volume resistivity of the non-adsorbed activated alumina was $1.01\times10^{8}\Omega$-cm as measured under the same conditions.

EXAMPLE 6

(A) Ethylenediamine sulfate having a volume resistivity of $2.74\times10^{8}\Omega$-cm (B) Activated clay having a volume resistivity of $2.02\times10^{7}\Omega$-cm In 12 parts by weight of a 16% aqueous solution of ethylenediamine sulfate was dipped 3 parts by weight of activated clay for 10 minutes, and the solid was recovered by filtration, washed with a small amount of water and dried at 50° C. overnight. The resulting solid contained 2.7% by weight of the protonically conductive solid and was found to have a volume resistivity of $1.00\times10^{6}\Omega$-cm, which was about 1/20 of the non-adsorbed starting activated clay.

EXAMPLE 7

Cyclohexylamine sulfate as the protonically conductive solid was adsorbed and supported on bentonite as the solid acid in an amount of about 4% by weight. The humidity dependency of the electric conductivity of the resulting sample was examined to obtain results shown in Table 3.

Table 3

| Sample | Conductivity ($\Omega^{-1}$-cm$^{-1}$) 21° C., 36% RH | 22.5° C., 93% RH | $\delta_{50}/\delta_{30}$ |
|---|---|---|---|
| non-adsorbed | $7.93\times10^{-7}$ | $3.13\times10^{-5}$ | 39.5 |
| cyclohexylamine sulfate adsorbed | $2.30\times10^{-6}$ | $1.60\times10^{-5}$ | 6.96 |

From the results shown in Table 3, it will readily be understood that the electric conductivity of bentonite alone is remarkably changed by the change of the humidity and the resistivity is high at a low humidity but low at a high humidity, and that the humidity dependency of the electric conductivity of bentonite alone is much higher than that of the protonically conductive solid-adsorbed sample.

EXAMPLE 8

In the same manner as described in Example 6, piperidine sulfate having a volume resistivity of $3.54\times10^{7}\Omega$-cm as the protonically conductive solid was adsorbed and supported on acid clay having a volume resistivity of $1.05\times10^{7}\Omega$-cm as the solid acid. The volume resistivity of the resulting sample was found to be $1.17\times10^{5}\Omega$-cm, which was about 1/90 of the volume resistivity of the starting acid clay.

What we claim is:

1. A solid conducting agent comprising a finely divided inorganic solid acid and at least 0.5% by weight of a protonically conductive solid absorbed and supported on said finely divided inorganic solid acid, said finely divided inorganic solid acid having an absorbing property characterized by a specific surface area of at least 50 $m^2/g$, said protonically conductive solid being an acid addition salt of an organic base, wherein the organic base satisfies at least one of the following two requirements: (i) the ratio (C/N) of the number of carbon atoms to the number of nitrogen atoms is in the range of from 0 to 8 and (ii) the first stage base dissociation constant (pKb) is in the range of from 0.3 to 8, as measured at 20° C.

2. A solid conducting agent as set forth in claim 1 wherein the volume resistivity of said protonically conductive solid is lower than $1\times10^{13}\Omega$-cm as measured in the absolutely dry state.

3. A solid conducting agent as set forth in claim 1 wherein the organic base satisfies the following two requirements: (i) the ratio (C/N) of the number of carbon atoms to the number of nitrogen atoms is in the range of from 1 to 4 and (ii) the first stage base dissociation constant (pKb) is in the range of from 2 to 6, as measured at 20° C.

4. A solid conducting agent as set forth in claim 1 wherein the acid of the protonically conductive solid is an inorganic or organic acid having a first stage acid dissociation constant (pKb) not higher than 6.5, as measured at 25° C.

5. A solid conducting agent as set forth in claim 1 wherein the finely divided solid acid is a fine powder of a clay mineral, acid-treated clay mineral or amorphous silica.

6. A solid conducting agent as set forth in claim 1 wherein the protonically conductive solid is adsorbed and supported in an amount of 0.5 to 20% by weight based on the finely divided inorganic solid acid.

7. A solid conducting agent as set forth in claim 1 wherein a polyhydric alcohol having a vapor pressure lower than 0.1 mm Hg as measured at 20° C. and being liquid under normal conditions is further adsorbed and supported on the finely divided inorganic solid acid in an amount of 0.5 to 10% by weight based on the finely divided inorganic solid acid.

8. A solid conducting agent as set forth in claim 1 wherein the acid is an inorganic or organic acid having a first stage acid dissociation constant (pKb) not higher than 5, as measured at 25° C.

* * * * *